US008714233B2

(12) United States Patent
Goller et al.

(10) Patent No.: US 8,714,233 B2
(45) Date of Patent: May 6, 2014

(54) CASTING PROCESS, MATERIALS AND APPARATUS, AND CASTINGS PRODUCED THEREWITH

(75) Inventors: George Albert Goller, Greenville, SC (US); Dennis William Cavanaugh, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 475 days.

(21) Appl. No.: 13/074,268

(22) Filed: Mar. 29, 2011

(65) Prior Publication Data

US 2012/0247621 A1 Oct. 4, 2012

(51) Int. Cl.
*B22C 3/00* (2006.01)
*B22C 1/00* (2006.01)

(52) U.S. Cl.
USPC ..... 164/138; 164/517; 164/519

(58) Field of Classification Search
USPC ..... 164/517, 518, 519, 72, 138, 529
See application file for complete search history.

(56) References Cited

U.S. PATENT DOCUMENTS

| | | | | |
|---|---|---|---|---|
| 3,972,367 | A | 8/1976 | Gigliotti, Jr. et al. | |
| 6,074,602 | A | 6/2000 | Wukusick et al. | |
| 6,500,283 | B1 | 12/2002 | Schaeffer et al. | |
| 2010/0304161 | A1* | 12/2010 | Huang et al. | 428/469 |
| 2011/0315338 | A1* | 12/2011 | Gigliotti et al. | 164/24 |

FOREIGN PATENT DOCUMENTS

| | | | |
|---|---|---|---|
| DE | 10065924 | A1 | 9/2002 |
| EP | 0045416 | A1 | 2/1982 |
| EP | 0554198 | A1 | 8/1993 |
| EP | 1839775 | A1 | 10/2007 |
| EP | 2141263 | A2 | 1/2010 |
| EP | 2143512 | A1 | 1/2010 |
| JP | 8066742 | A | 3/1996 |
| JP | 2002239713 | A | 8/2002 |
| JP | 2004074202 | A | 3/2004 |

OTHER PUBLICATIONS

Search Report and Written Opinion from corresponding EP Application No. 12161557.9-2122 dated Jul. 2, 2012.
Aguero, A. et al., "Cyclic oxidation and mechanical behaviour of slurry aluminide coatings for steam turbine components", vol. 201, No. 14, pp. 6253-6260, Feb. 20, 2007.

* cited by examiner

*Primary Examiner* — Kevin P Kerns
(74) *Attorney, Agent, or Firm* — Ernest G. Cusick; Gary M. Hartman; Domenica N. S. Hartman

(57) ABSTRACT

A casting process for producing metal alloy castings, facecoats and apparatuses suitable for carrying out the process, and castings produced by the process. The casting process entails the use of a mold having a cavity with a continuous aluminum-containing solid facecoat on its surface. A molten quantity of a metal alloy is introduced into the mold cavity so that the molten alloy contacts the solid facecoat. The mold is then allowed to cool to solidify the molten alloy and form a cast product. During the casting process, aluminum in the solid facecoat diffuses into the cast product to form an aluminum-containing surface region at the casting surface. Following removal of the cast product from the mold, an alumina-containing scale grows on the casting surface as a result of oxidation of the casting surface region.

28 Claims, 1 Drawing Sheet

CASTING PROCESS, MATERIALS AND APPARATUS, AND CASTINGS PRODUCED THEREWITH

BACKGROUND OF THE INVENTION

The present invention generally relates to casting processes and the equipment and materials used in casting processes. More particularly, the invention relates to a metal casting process adapted to simultaneously form an oxidation-resistant surface region in a cast product produced by the process, which can otherwise be a conventional casting process such as, but not limited to, iron-based alloy casting and sand casting processes.

Internal components of gas turbines, including gas turbine engines used to the power generation and aircraft industries, must be capable of operating at high temperatures, often above 1000° F. (about 540° C.). Because the efficiency of a gas turbine is dependent on its operating temperatures, there is a continuing demand for gas turbine components with higher temperature capabilities. As the material requirements for gas turbine components have increased, various processing methods, alloying constituents and coatings have been developed to enhance the mechanical, physical and environmental properties of gas turbine components.

To promote oxidation resistance and acceptable operating life, internal components of gas turbine engines are often produced as castings from high-alloy stainless steels, nickel and cobalt alloy steels, cobalt-based alloys and nickel-based alloys. These alloys rely on chromium and/or nickel as alloy additions to form an oxidation-resistant scale as a surface layer capable of protecting the alloy from high temperature and oxidizing conditions within gas turbines. The scale is predominantly chromium oxide (chromia; $Cr_2O_3$) and nickel oxide (NiO) as a result of the chromium and nickel contents of these steels, for example, about 18 weight percent or more of chromium and about 8 weight percent or more of nickel in austenitic stainless steels, about 20 weight percent or more of chromium in nickel and cobalt alloy steels, nickel-based alloys and cobalt-based alloys, and about 50 weight percent or more of nickel in nickel-based alloys. The scale effectively passivates the component surface, preventing further corrosion at the component surface and inhibiting corrosion beneath the surface. Though providing the advantage of oxidation resistance, these alloys are typically much more expensive than low-alloy steels and irons, which typically contain less than 10 weight percent chromium and little if any nickel.

It is well known that an aluminum oxide (alumina; $Al_2O_3$) scale can offer superior protection over chromium oxide and nickel oxide in many high temperature applications. Certain nickel-based superalloys, for example, René N5 (U.S. Pat. No. 6,074,602), contain a sufficient amount of aluminum to promote the growth of a stable alumina scale. However, the addition of aluminum to molten steel alloys during the initial manufacturing process is difficult and often impractical or uneconomical.

As an alternative, aluminum can be diffused into the surface of a component using a diffusion process, such as pack cementation, vapor phase (gas phase) aluminiding (VPA), or chemical vapor deposition (CVD). Such diffusion processes generally entail reacting the surface of the component with an aluminum-containing vapor to form an additive layer at the component surface and a diffusion zone beneath the additive layer. The additive layer typically contains an environmentally-resistant intermetallic phase MAl (where M is iron, nickel or cobalt, depending on the substrate material), and the diffusion zone typically contains various intermetallic and metastable phases of aluminum and elements present in the substrate. While effective, diffusion aluminide processes require an additional processing step after casting that includes a thermal treatment, which for some applications is impractical and in all cases incurs additional cost and time.

In view of the above, there is an ongoing desire to produce iron-based alloy cast products that contain relatively low levels of alloying constituents, yet are capable of exhibiting adequate oxidation resistance for use in high temperature oxidizing environments, as is the case with internal components of gas turbine engines.

BRIEF DESCRIPTION OF THE INVENTION

The present invention provides a casting process for producing a cast product, in which the process forms an aluminum-containing surface region in the cast product that is capable of forming an oxidation-resistant alumina-containing scale on the product surface. The invention also provides facecoats and apparatuses suitable for carrying out the process, and cast products produced by the process.

According to a first aspect of the invention, the casting process entails providing a mold with a cavity and a continuous solid facecoat on a mold surface within the cavity. The solid facecoat contains at least 15 weight percent of a powder containing metallic aluminum and optionally an activator. A molten quantity of a metal alloy is introduced into the cavity of the mold so that the molten alloy contacts the solid facecoat. The mold is then allowed to cool to solidify the molten quantity of alloy and form a cast product of the alloy. During the casting process, at least a portion of the metallic aluminum in the solid facecoat diffuses into the surface to form an aluminum-containing surface region in the cast product. If present in the solid facecoat, the activator promotes the diffusion of metallic aluminum into the surface by reacting with the powder to form a volatile aluminum compound, which then reacts at the surface of the molten alloy and/or cast product contacting the solid facecoat to infuse metallic aluminum into the surface. Following removal of the cast product from the mold, a scale is capable of growing on the surface of the cast product as a result of oxidation of the surface region of the cast product. The scale contains alumina as a result of the oxidation of the aluminum infused into the surface region of the cast product during the casting process.

Additional aspects of the invention include a facecoat gel used to form the solid facecoat described above, as well as cast products produced by the process described above. The alumina scale is sufficiently continuous on the surface of the cast product and is present in an amount sufficient to serve as a passivation layer that inhibits oxidation and corrosion of the cast product surface.

Yet another aspect of the invention is the solid facecoat employed in the casting process described above, and in particular a casting apparatus that makes use of a mold and a continuous solid facecoat on a mold cavity surface of the mold. The solid facecoat contains at least 15 weight percent of a powder containing metallic aluminum and optionally an activator. The cavity of the mold is adapted to receive a molten quantity of a metal alloy so that the molten alloy contacts the solid facecoat.

Alloys with which this invention can be used include iron-based alloys, and particularly low-alloy iron-based alloys and steels that may contain chromium but typically little or no nickel, and as a result do not exhibit adequate oxidation resistance when exposed to the environment of a gas turbine engine. The invention is also applicable to other alloys, including nickel-based and cobalt-based alloys capable of benefitting from a passivating layer of alumina-containing scale formed by the process. A notable advantage of the invention is that the solid facecoat contacts the molten alloy during the casting process, with the result that metallic aluminum from the solid facecoat diffuses into the alloy while still molten and/or during solidification to form an aluminum-rich surface region capable of forming a continuous, adherent and protective alumina scale on the surface of the cast product.

Other aspects and advantages of this invention will be better appreciated from the following detailed description.

DETAILED DESCRIPTION OF THE INVENTION

Figure 1:
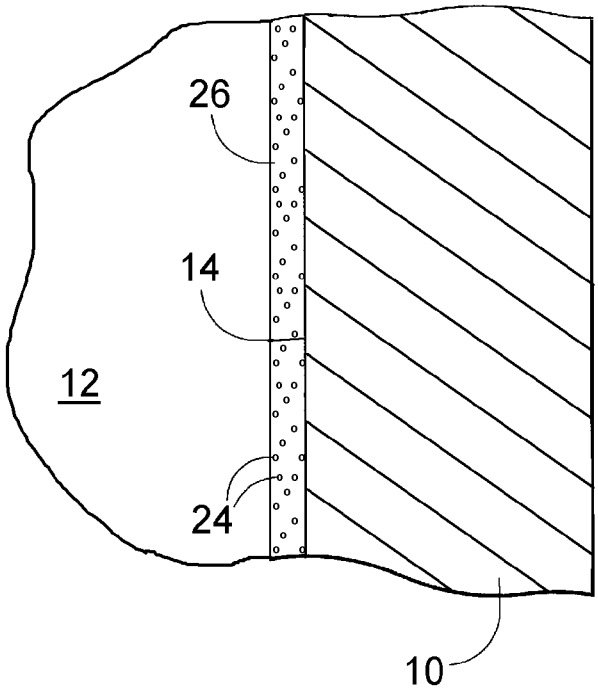
FIG. 1 represents a fragmentary cross-sectional view of a mold assembly and shows a facecoat gel applied to an interior mold cavity surface in accordance with an embodiment of the invention.
Figure 2:
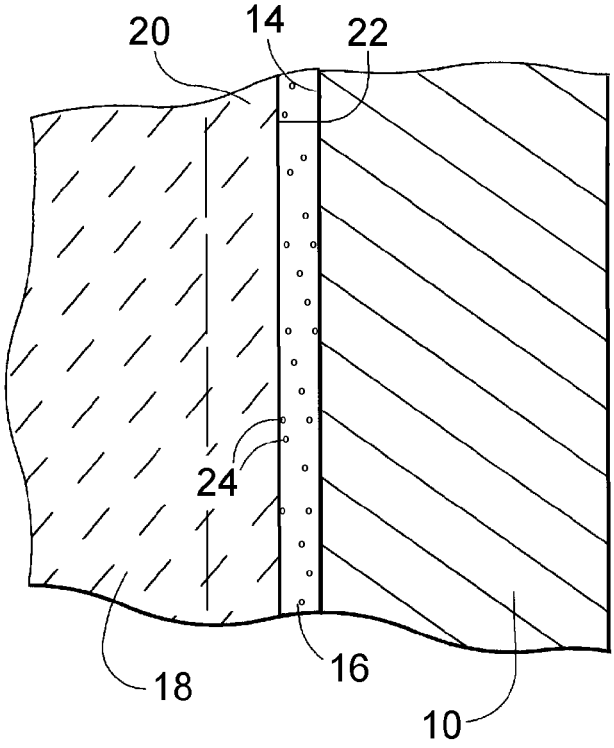
FIG. 2 represents a fragmentary cross-sectional view of the mold assembly of FIG. 1 and shows a cast product contacting a solid facecoat formed by the facecoat gel of FIG. 1.

FIGS. 1 and 2 schematically represent portions of a casting apparatus that can be used with the present invention. The apparatus and its following description are intended as a nonlimiting representation that shows a mold 10, for example, a permanent mold or a sand mold, capable of use in a casting process to produce metallic castings (18 in FIG. 2). As known in the art, the mold 10 is preferably formed of a refractory material whose surface may be protected by a ceramic face coating. The mold 10 defines an internal mold cavity 12 whose surface 14 has the desired shape of the cast product 18, for example, an internal component of a gas turbine engine. Particular but nonlimiting examples of such components include diaphragms, shrouds and other static gas turbine parts. As represented in FIG. 2, the mold cavity surface 14 is provided with a solid facecoat 16, which will be described in more detail below.

The mold 10, its cavity 12 and cavity surface 14 can be fabricated or otherwise formed in any suitable manner, and therefore will not be discussed in any detail here. The mold 10 and its cavity 12 may by used in combination with one or more cores (not shown) for the purpose of forming internal cavities or passages within the cast product 18. Furthermore, the mold 10 can be adapted to be cooled in any manner suitable for the intended cast product 18. In addition, depending on the particular alloy being cast, the casting process using the mold 10 can be carried out in air, a vacuum or an inert atmosphere. In use, after the mold 10 is preheated, for example, to a temperature of about 200 to about 1000° F. (about 90 to about 540° C.), a molten quantity of the alloy is poured into the preheated mold 10 and then, in accordance with conventional practices, the mold 10 is allowed to cool to initiate and complete solidification of the alloy.

Various alloys can be cast using a mold of the type represented in FIGS. 1 and 2. Of particular interest to the invention is the casting of iron-based alloys, and especially iron alloys and low-alloy steel alloys that do not contain sufficient chromium, nickel or other oxide formers to form a continuous protective scale, for example, a continuous chromium oxide or nickel oxide scale, in an amount capable of achieving a desired level of oxidation resistance to the cast product 18. As an example, certain iron-based alloys are likely to contain not more than 10 weight percent of alloying constituents in total, with the balance being iron and incidental impurities. Such alloying constituents typically include one or more of chromium, manganese and carbon. Of particular interest are iron-based alloys that contain not more than 10 weight percent chromium and little (less than 1 weight percent) if any intentional additions of nickel, for example, certain low-alloy steels that contain 8 to 10 weight percent of chromium and less than 1 weight percent of nickel, other low-alloy steels that contain 1 to 8 weight percent of chromium and less than 1 weight percent of nickel, and still other low-alloy steels that contain less than 1 weight percent of chromium and nickel. These levels of chromium and nickel are in contrast to high-alloy stainless steels and nickel alloy steels commonly used to form components of gas turbines, which due to their high temperature operating requirements often contain 18 weight percent or more of chromium and/or 8 weight percent or more of nickel, which is often sufficient to form protective surface oxides. Notable examples of such alloys include stainless steel grades such as 304, 316, 310 and nickel grades such as 800, 625 and 738.

It should be noted that the benefits of this process could be extended to the casting of other iron-based alloys, for example, ferritic steels (with typical chromium contents of up to about 17 weight percent). The benefits of this process can also be extended to the casting of metal alloys other than iron-based alloys, and in particular to metal alloys that contain insufficient amounts of chromium, nickel or other oxide formers to form a continuous protective scale in an amount capable of achieving a desired level of oxidation resistance to the cast product 18. Notable examples of such alloys include certain nickel-based and cobalt-based alloys of types often used to produce cast components of gas turbines.

A particular aspect of this invention is to compensate for the lack of oxide formers in the alloy by diffusing an amount of metallic aluminum into a surface region 20 of the cast product 18 (FIG. 2) to promote the oxidation resistance of the cast product 18 and, in particular, promote the formation of an oxide scale (not shown) on its surface 22 that is predominantly alumina (in other words, the scale contains more alumina by weight than any other individual oxide constituent). As previously noted, FIG. 2 represents a fragment of a wall section of the mold 10 as having a solid facecoat 16 applied to its interior cavity surface 14, so that the molten alloy contacts the solid facecoat 16 as it is introduced into the mold cavity 12. The solid facecoat 16 is schematically represented as containing a dispersion of metallic aluminum-containing particles 24, which constitute at least 15 weight percent of the solid facecoat 16, for example at least 50 weight percent of the solid facecoat 16, more preferably at least 65 weight percent to about 90 weight percent of the solid facecoat 16. The composition of the solid facecoat 16 is such that its metallic aluminum content is sufficient to provide a source of metallic aluminum for diffusion into the cast product 18 during the casting process to form the surface region 20 represented in FIG. 2. In particular, the aluminum content in the solid facecoat 16 and the temperature of the molten iron-based alloy and cast product 18 during the casting process are sufficient in combination to cause diffusion of metallic aluminum from the solid facecoat 16 into the surface region 20 of the cast product 18. Minimum temperatures sufficient to achieve this effect depend in part on the composition of the particles 24. A temperature of about 1300° F. (about 705° C.) is believed to be adequate if the particles 24 are essentially aluminum (with impurities), and a temperature of about 1400° F. (about 760° C.) is believed to be adequate if the particles 24 are essentially an aluminum alloy whose predominant constituent is aluminum, nonlimiting examples of which include CrAl, CoAl, NiAl, FeAl, MoAl, MnAl, AlZr and AlNb alloys. As discussed in more detail below, the diffusion of aluminum into the surface region 20 can be further promoted by the presence of an activator in the solid facecoat 16, which preferably constitutes up to about 35 weight percent of the solid facecoat 16, for example about 10 to about 35 weight percent of the solid facecoat 16, more preferably about 10 to about 20 weight percent of the solid facecoat 16. The balance (if any) of the solid facecoat 16 may be solids that are inert to the casting process.

The surface region 20 can be referred to as an aluminum-rich surface region 20 of the cast product 18, in that its aluminum content resulting from the diffusion process exceeds the aluminum content (if any) in the remainder of the cast product 18. The aluminum content in the surface region 20 is preferably greater than 10 weight percent, more preferably greater than 12 weight percent, in order for the casting surface 22 defined by the surface region 20 to be able to form a continuous oxide scale that will contain a sufficient amount of alumina to promote the oxidation resistance of the cast product 18. A particularly suitable range is believed to be 14 to about 40 weight percent aluminum in the surface region 20. The aluminum content within the surface region 20 is generally in the form of one or more intermetallics, whose compositions depend on the composition of the casting surface 22. For example, an iron-based casting surface will form FeAl intermetallic, a nickel-based casting surface will form NiAl intermetallic, and a cobalt-based casting surface will form CoAl intermetallic. The surface region 20 preferably extends at least 50 micrometers below the surface 22 of the cast product 18, for example, in a range of about 50 to about 300 micrometers and possibly farther (for example, about 400 micrometers) below the casting surface 22. Due to the diffusion process, the aluminum content will not be uniform throughout the thickness of the region 20, but instead will tend to decrease in a direction away from the casting surface 22, such that the aluminum content at the interface between the surface region 20 and the bulk casting will be essentially the same as the aluminum content (if any) within the alloy used to form the cast product 18.

The aluminum content within the solid facecoat 16 is in the form of discrete particles 24 due to of the particular process by which the solid facecoat 16 was formed. In particular, FIG. 1 represents a facecoat gel 26 applied to the surface 14 of the mold 10, which is then heated to form the solid facecoat 16 shown in FIG. 2. The facecoat gel 26 contains the aluminum-containing particles 24 as well as an activator, which are both suspended in the facecoat gel 26 of FIG. 1 such that the particles 24 are dispersed in the solid facecoat 16 of FIG. 2 by a solid binder phase formed by the activator. To promote the dispersion of the particles 24 in the solid facecoat 16 and diffusion of aluminum into the surface region 20, the particles 24 and activator are preferably in the form of powders. A suitable particle size range for the aluminum-containing particles 24 is up to about 100 mesh (about 149 micrometers), more preferably a range of about 200 to about 325 mesh (about 74 to about 44 micrometers). Suitable activators for use with the invention include known halide activators, particularly fluoride or chloride salts such as sodium fluoride (NaF), potassium fluoride (KF), ammonium chloride ($NH_4Cl$), ammonium fluoride ($NH_4F$), ammonium bromide ($NH_4Br$), ammonium iodide ($NH_4I$), and ammonium bifluoride ($NH_4HF_2$). When the solid facecoat 16 is subjected to the elevated temperature of the molten alloy, the activator reacts with the aluminum in the solid facecoat 16 to form a volatile aluminum halide (e.g., $AlF_3$), which then reacts at the casting surface 22 and/or the surface of the molten alloy contacting the solid facecoat 16 to deposit and diffuse aluminum and form the aluminum-containing surface region 20.

Aside from the particles 24 and activator, the composition of the facecoat gel 26 is made up of an organic polymer binder. Suitable binders should burn off without leaving any residue so that the solid facecoat 16 is not contaminated by binder residue. A particular example of a suitable binder meeting these criteria is VITTA GEL®, a water-based organic polymeric binder commercially available from the Vitta Corporation. Other organic polymeric binders could foreseeably be used. Because the binder cleanly burns off when the facecoat gel 26 is sufficiently heated, the solid facecoat 16 is essentially the particles 24 of aluminum or aluminum alloy in the solid binder phase formed by the activator. The organic polymer binder preferably does not constitute more than 70 weight percent and more preferably about 20 to about 50 weight percent of the facecoat gel 26, with the balance preferably being the particles 24 and activator (e.g., about 40 to about 60 weight percent of the particles 24 and about 10 to about 20 weight percent of the activator to obtain the above-noted preferred ranges). The facecoat gel 26 contains a sufficient amount of organic polymer binder to promote the ease with which the facecoat gel 26 can be applied to the mold surface 14. As such, the amount of polymer binder in the facecoat gel 26 will depend on the size and amount of the powder particles 24, as well as the form and amount of the activator. It is also within the scope of the invention to form the facecoat gel 26 with only the particles 24 and organic polymer binder, with the result that the solid facecoat 16 may be essentially entirely a layer of metallic aluminum or aluminum alloy.

The facecoat gel 26 can be prepared by standard techniques using conventional mixing equipment, and then undergo conventional processes to form the solid facecoat 16 on the mold cavity surface 14, such as by dipping, spraying, or another suitable technique. The facecoat gel 26 can be applied as a single layer or as multiple layers, for example, to achieve a desired thickness for the facecoat gel 26 on the cavity surface 14. The viscosity of the facecoat gel 26 is preferably such that the facecoat gel 26 can be applied to the mold surface 14 to achieve a final thickness of at least 50 micrometers, more preferably a range of about 100 to about 300 micrometers. Preferred thicknesses for the facecoat gel 26 will depend on various factors, including its aluminum content and the desired aluminum content for the surface region 20.

Prior to introducing the molten alloy into the mold cavity 12, the facecoat gel 26 is preferably heated to burn off the polymer binder and form the solid facecoat 16 shown in FIG. 2. A facecoat gel 26 having the composition described above results in the solid facecoat 16 comprising the aluminum-containing particles 24 dispersed in the solid binder phase formed by the activator. Heating of the facecoat gel 26 to form the solid facecoat 16 can be performed at temperatures in a range of about 200 to about 500° F. (about 90 to about 260° C.) prior to introducing the molten alloy into the mold cavity 12. This treatment can be achieved as the mold 10 is preheated prior to the molten alloy being introduced into the mold cavity 12. As the molten alloy comes into contact with the solid facecoat 16, the composition of the particles 24, and in particular their metallic aluminum content, diffuses from the solid facecoat 16 into the alloy while molten and during solidification to form the aluminum-rich surface region 20. If present, the activator within the solid binder phase of the solid facecoat 16 further promotes the deposition and diffusion of aluminum into the surface region 20 by reacting with the aluminum in the solid facecoat 16 to form a volatile aluminum halide, which then reacts with the surface of the molten alloy contacting the solid facecoat 16 as well as the casting surface 22 as solidification progresses.

As noted above, the aluminum content of the surface region 20 is sufficient to form a continuous and adherent alumina-containing oxide scale on the surface 22 of the cast product 18. The oxide scale is continuous in the sense that the oxide scale is present and covers the entire aluminum-rich surface region 20. Such an oxide scale thermally grows on the casting surface 22 defined by surface region 20 as a result of exposing the cast product 18 to elevated temperatures in the presence of oxygen. This exposure can be the result of the operating environment of the component produced from the cast product 18, or the result of a thermal pretreatment specifically intended to thermally grow the oxide scale. Alternatively or in addition, growth of the oxide scale can occur during a heat treatment of the cast product 18 that may be performed to develop the desired mechanical properties of the alloy. To provide adequate oxidation resistance, the scale preferably contains at least 12 weight percent alumina, and more preferably at least 15 weight percent alumina, with the balance being oxides that might form as a result of the iron-based alloy containing other oxide formers, for example, chromium and nickel. Because of the preference for using low-alloy iron-based alloys in this process, the scale that forms on the cast product 18 will contain less chromium oxide and nickel oxide than alumina, and more typically contain not more than about 10 weight percent chromium oxide and little or no nickel oxide.

In view of the above, the present invention allows low-alloy iron-based alloys to be used in place of more expensive chrome-nickel alloy steels in a variety of high temperature applications, for example, various internal components of gas turbine engines. The invention achieves this aspect by improving the oxidation resistance of low-alloy iron-based alloys with a more protective oxide scale whose predominant constituent is alumina.

While the invention has been described in terms of particular embodiments, it is apparent that other forms could be adopted by one skilled in the art. Therefore, the scope of the invention is to be limited only by the following claims.

The invention claimed is:

1. A process for producing a cast product from a metal alloy, the process comprising:

providing a mold with a cavity and a continuous solid facecoat on a mold surface within the cavity, the solid facecoat comprising at least 15 weight percent of a powder containing metallic aluminum and an activator;

introducing a molten quantity of the metal alloy into the cavity of the mold so that the molten metal alloy contacts the solid facecoat and the activator vaporizes and reacts with the metallic aluminum in the solid facecoat to form a volatile aluminum compound;

cooling the mold to cool and solidify the molten quantity of the metal alloy and form a cast product of the metal alloy, during which at least a portion of the volatile aluminum compound reacts at the surface of the molten quantity of the alloy and/or the cast product contacting the solid facecoat to infuse the metallic aluminum into a surface of the cast product to form an aluminum-containing surface region in the cast product;

removing the cast product from the mold; and then growing a scale on the surface of the cast product as a result of oxidation of the surface region of the cast product, the scale comprising alumina as a result of oxidation of aluminum in the surface region of the cast product.

2. The process according to claim 1, wherein the powder containing the metallic aluminum in the solid facecoat consists of aluminum and incidental impurities.

3. The process according to claim 1, wherein the metallic aluminum in the solid facecoat is in the form of an aluminum alloy chosen from the group consisting of CrAI, CoAl, NiAI, FeAI, MoAl, MnAI, AIZr and AINb alloys.

4. The process according to claim 1, wherein the powder containing the metallic aluminum is dispersed in a solid binder phase comprising the activator.

5. The process according to claim 1, wherein the activator is a halide activator that promotes the diffusion of the metallic aluminum into the surface region by reacting with the metallic aluminum in the solid facecoat to form a volatile aluminum halide, which then reacts with the surface of the molten alloy contacting the solid facecoat during the introducing step and the surface of the cast product during the cooling step.

6. The process according to claim 1, the process further comprising:

forming a facecoat gel comprising the powder containing metallic aluminum and the activator in an organic polymer binder;

applying the facecoat gel to the mold surface; and heating the facecoat gel to burn off the organic polymer binder and form the solid facecoat in which the metallic aluminum is dispersed in a solid binder phase formed by the activator.

7. The process according to claim 6, wherein the powder containing the metallic aluminum in the facecoat gel consists of aluminum and incidental impurities.

8. The process according to claim 6, wherein the metallic aluminum in the facecoat gel is in the form of an aluminum alloy chosen from the group consisting of CrAI, CoAI, NiAI, FeAI, MoAI, MnAI, AIZr and AINb alloys.

9. The process according to claim 6, wherein the facecoat gel contains up to about 70 weight percent of the organic polymer binder.

10. The process according to claim 6, wherein the facecoat gel contains about 10 to about 20 weight percent of the activator.

11. A facecoat gel formed by the process of claim 6.

12. The process according to claim 1, wherein the metal alloy contains not more than 10 weight percent of alloying constituents and the balance is iron and incidental impurities.

13. The process according to claim 12, wherein the metal alloy contains not more than 10 weight percent of chromium and not more than 1 weight percent of nickel.

14. The process according to claim 1, wherein the scale contains at least 12 weight percent alumina.

15. The process according to claim 1, wherein the scale contains less than 10 weight percent chromium oxide.

16. The process according to claim 1, wherein the cast product is a gas turbine engine component.

17. A process for producing a cast product from a metal alloy, the process comprising:

providing a mold with a cavity and a continuous solid facecoat on a mold surface within the cavity, the solid facecoat comprising at least 15 weight percent of a powder containing metallic aluminum and a halide activator;

introducing a molten quantity of the metal alloy into the cavity of the mold so that the molten metal alloy contacts the solid facecoat, the halide activator reacting with the metallic aluminum in the solid facecoat to form a volatile aluminum halide;

cooling the mold to cool and solidify the molten quantity of the metal alloy and form a cast product of the metal alloy, during which at least a portion of the metallic aluminum in the solid facecoat diffuses into a surface of the cast product to form an aluminum-containing surface region in the cast product, the volatile aluminum halide reacting with the surface of the cast product;

removing the cast product from the mold; and then growing a scale on the surface of the cast product as a result of oxidation of the surface region of the cast product, the scale comprising alumina as a result of oxidation of aluminum in the surface region of the cast product;

wherein the volatile aluminum halide promotes diffusion of the metallic aluminum into the surface region by reacting with the surface of the molten alloy contacting the solid facecoat during the introducing step and reacting with the surface of the cast product during the cooling step.

18. The process according to claim 17, wherein the metallic aluminum in the solid facecoat is in the form of an aluminum alloy chosen from the group consisting of CrAI, CoAI, NiAI, FeAI, MoAI, MnAI, AIZr and AINb alloys.

19. The process according to claim 17, wherein the powder containing the metallic aluminum is dispersed in a solid binder phase formed by the halide activator.

20. The process according to claim 17, the process further comprising:

forming a facecoat gel comprising the powder containing metallic aluminum and the halide activator in an organic polymer binder;

applying the facecoat gel to the mold surface; and heating the facecoat gel to burn off the organic polymer binder and form the solid facecoat in which the metallic aluminum is dispersed in a solid binder phase formed by the activator.

21. The process according to claim 20, wherein the metallic aluminum in the facecoat gel is in the form of an aluminum alloy chosen from the group consisting of CrAI, CoAI, NiAI, FeAI, MoAI, MnAI, AIZr and AINb alloys.

22. The process according to claim 20, wherein the facecoat gel contains up to about 70 weight percent of the organic polymer binder.

23. A facecoat gel formed by the process of claim 20.

24. The process according to claim 17, wherein the metal alloy contains not more than 10 weight percent of alloying constituents and the balance is iron and incidental impurities.

25. The process according to claim 24, wherein the metal alloy contains not more than 10 weight percent of chromium and not more than 1 weight percent of nickel.

26. The process according to claim 17, wherein the scale contains at least 12 weight percent alumina.

27. The process according to claim 17, wherein the scale contains less than 10 weight percent chromium oxide.

28. The process according to claim 17, wherein the cast product is a gas turbine engine component.

* * * * *